US006254209B1

(12) United States Patent
Parvin

(10) Patent No.: US 6,254,209 B1
(45) **Date of Patent: *Jul. 3, 2001**

(54) DRAWER SLIDE FLOATING BUMPER DETENT

(75) Inventor: Jackie D. Parvin, Pomona, CA (US)

(73) Assignee: Accuride International, Inc, Santa Fe Springs, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/192,797

(22) Filed: Nov. 16, 1998

(51) Int. Cl.[7] ..... A47B 88/04

(52) U.S. Cl. ..... 312/334.44; 312/334.11

(58) Field of Search ..... 312/334.1, 334.7, 312/334.8, 334.11, 334.16, 334.22, 330.1, 333, 334.44, 334.46; 384/18, 20, 21

(56) References Cited

U.S. PATENT DOCUMENTS

| | | | | |
|---|---|---|---|---|
| 4,370,007 | * | 1/1983 | Fler | 312/334.11 |
| 4,469,384 | | 9/1984 | Fler et al. | 312/333 |
| 4,932,792 | | 6/1990 | Baxter | 384/18 |
| 5,411,333 | | 5/1995 | Hoffman | 384/18 |
| 5,466,060 | * | 11/1995 | Hoffman | 312/334.11 X |
| 5,507,571 | * | 4/1996 | Hoffman | 312/334.46 X |
| 5,722,750 | * | 3/1998 | Chu | 312/334.46 X |

FOREIGN PATENT DOCUMENTS 3005817 8/1986 (DE) .

OTHER PUBLICATIONS

Hettich, Bumper/Tab, lp. No Date given.
Knape & Vogt, Models 8400/8405 Drawer Slides, Apr. 1995, lp.
Thomas Regout Model ULF Bumper/Tab, lp. No Date given.
Thomas Regout B.V. Anchor, Model TR 200 Bumper/Tab, lp. No Date Given.
Shelby, Bumper/Tab, lp. No Date Given.
Skytechno, Model 630–20 Bumper/Tab, lp. No Date Given.
Waterloo, Model 3178, 2100F Bumper/Tab, lp. No Date Given.
Waterloo, Model 3400 Bumper/Tab, lp. No Date Given.
Waterloo, Model 3690 Bumper/Tab, lp. No Date Given.
Waterloo, Self Closing Bumper/Tab, lp. No Date Given.
WFC, Model 3100 Series Drawer Slides brochure, lp. No Date Given.
Taiwanese 2 Member Slide, lp. No Date Given.
Taiwanese Bumper/Tab, lp. No Date Given.

(List continued on next page.)

*Primary Examiner*—Peter M. Cuomo
*Assistant Examiner*—James O. Hansen
(74) *Attorney, Agent, or Firm*—Christie, Parker & Hale, LLP

(57) ABSTRACT

A floating bumper is provided for a drawer slide rear stop. The bumper has a slot for receiving a rear stop tab. The bumper slot is wider than the tab to permit slight side to side movement of the bumper when the drawer slide is fully retracted and to eliminate tension on the bumper. The rear stop tab has notches to accommodate projections formed within the bumper slot. The bumper projections fit loosely and do not engage the notches unless disengagement of the bumper from the rear stop is attempted. The peripheral edges as well as the slot edges of the bumper are chamfered.

19 Claims, 6 Drawing Sheets

OTHER PUBLICATIONS

Unknown Bumper/Tab (Slide No. 14), lp. No Date Given.
Model NJ–301 Side Mounting slide, lp. No Date Given.
Model 3178 slide, lp. No Date Given.
Model 8350 Box Drawer Slide/8400 Box or Vertical File Drawer Slide, lp. No Date Given.
Accuride, Model 1157 Bumper/Tab, lp. No Date Given.
Accuride, Model 2632 Full Extension Slide brochure, 1998, 2pp.
Accuride, Model 3017 Bumper/Tab, lp. No Date Given.
Accuride, Models 3037, 3005, 3017, 3025 Full Extension Telescoping Slides brochure, 1995, 2pp.
Accuride, Model 3601 Bumper/Tab, lp. No Date Given.
Accuride, Model 9301 Extra Heavy Duty Drawer Slide brochure, 1999, 2pp.
Costsaver, Models B0001, B0010, B0035 slides, pp. 23–24. No Date Given.
Dynaslide, Models 46BM, 4635BM 46BMA, 4635BMA Full Extension Drawer Slide Bayonet Mountings, 1p. No Date Given.
Dynaslide, Models 4632, 4635 Full Extension Drawer Slide Mounting Systems, 1p. No Date Given.
Dynaslide, Model KV 8400 Bumper/Tab, lp. No Date Given.
Dynaslide, Bumper/Tab, lp. No Date Given.
Hettich, Full Extension Precision Ball Bearing Slide, lp. No Date Given.

* cited by examiner

DRAWER SLIDE FLOATING BUMPER DETENT

BACKGROUND OF THE INVENTION

The present invention relates to an improved stop for a drawer slide and specifically to a floating bumper for stopping and holding a drawer slide in a closed position.

Individual drawer slides consist of two or more members, a stationary member and at least one telescoping member. The stationary member is typically mounted in a cabinet or desk, while the telescoping member is typically connected to a drawer which is to be extended and retracted from the cabinet or desk. Drawer slides are typically provided in pairs, one for each side of the drawer. A three member slide has an intermediate member engaged by means of roller bearings and bearing retainers with the stationary member and the drawer member to enable longer drawer extensions.

In two member and three member slides, the members are coupled to each other by means of ball bearings. These ball bearings are preferably fitted within a channel shaped bearing retainer located between the slide members. Bearing retainers are fitted between slide members, e.g. the inner and intermediate slide member and between the intermediate and outer slide member. Each slide member also has a channel shape comprising a central web and two bent leg portions extending longitudinally along opposite sides of the central web.

When the telescoping member(s) is fully extended, the drawer is at the limit of its travel from the space within the cabinet in which it is mounted. When the drawer is fully retracted, the telescoping member encounters a rear stop. Typically, the rear stop is formed by bending a selected portion of the web of the stationary member such that it extends into the channel defined by the stationary member. The stop is thus a tab extending from the outer member into the pathway of the inner slide member, and into the pathway of the intermediate and inner slide members in a three member slide. In the usual design, a rubber bumper is force fitted over the rear stop member. In such embodiment, the rubber bumper is slotted and pushed down over the tab. Typically the slot is narrower than the width of the tab, and the bumper has to be stretched in order to fit it onto the tab putting the bumper into constant tension.

The bumper functions in the following manner. In a three member slide, when the intermediate member slides within a stationary member to its retracted position, its movement stops when the web of the intermediate member strikes the rubber bumper. The inner sliding member continues its travel until it also encounters the rubber bumper. When the inner member encounters the rubber bumper, the inner surfaces of the inner member bent leg portions, bracketing a cutout portion of the inner member web, engage and slide past the sides of the rubber bumper thereby compressing it slightly. As the inner member is slid further, a bent flange portion of the web of the inner member on the front end of the inner member also comes to a stop against a front stop. As the inner member front flange portion comes to a stop, the inner member bent rear legs move past the bumper and a slight inward cant of the bent rear legs causes the inner member to be held in place until a positive extension force is again applied to the slide. This retention action holds the drawer in a closed position until the next subsequent extension.

The constant stretching and compressing of the rubber bumper while mounted on the stop member provides fatigue and causes the elasticity of the bumper to deteriorate.

Consequently, the bumper cracks and ultimately fails. Since such bumpers are located at the rear end of slide on the stationary member, changing them is a problem after being mounted in a desk or cabinet. As such, there is a need for a rubber bumper for mounting on a stop member of a slide which has an enhanced operating life.

Moreover, when in a closed position, a significant section of the inner member rear end extends beyond the interior end of the ball retainer. The longer the slide, the longer the portion of the rear end of the inner member that extends beyond the retainer when the slide is in a closed position. Consequently, as the inner members slid rearwards to close the slide, the inner member rear portion may flex or bend slightly or be out of alignment. As a result, the inner member rear web may dig into the bumper and tend to cause the bumper to disengage from the rear stop tab as the inner member is slid back further. As such, there is a need for a bumper that will not disengage from the rear stop tab when a inner member accidentally contacts it.

SUMMARY OF THE INVENTION

In one aspect, the invention provides a bumper intended for use on a stop of a slide member, such as a rear stop formed in a stationary member of a drawer slide. The rear stop is a tab formed by bending a central portion of the web up into the channel defined by the stationary slide member. The bumper is fabricated of an elastomeric material in a generally flat configuration and has a central slot for receiving the stop tab. The slot in the bumper has a longitudinal dimension which is longer than the longitudinal dimension of the stop tab so that the bumper is not under tension when mounted on the tab.

In one embodiment, the stop tab has a notch formed on each of its vertical edges. Two projections formed inside the central slot of the bumper correspond to the notches on the tab to restrain the bumper from popping off the tab. Each interior projection in the slot has a length such that it penetrates into the space defined by each notch of the tab when the bumper is fitted in place over the stop tab. The projections approach, but do not engage the edges of the notches providing a loose fit. However, the length of the projections is such, that when attempting to disengage the bumper from the stop tab, the projections will engage the edges of the notches and thereby resist bumper disengagement.

To stiffen and prolong the life of the stop tab, the stop tab is sometimes supported by a gusset which is attached to the tab. To accommodate the gusset, a tubular passage is formed in the interior of the bumper extending upwardly into the slot. The tubular passage preferably extends through the bumper from one end to the other. The passage is larger than the gusset to provide a loose fit.

Preferably, the peripheral edges of the slot and the peripheral edges of the bumper are chamfered. When mounting the bumper on the tab, the chamfered slot edges engage and guide the tab into the slot. In case the inner slide member flexes or is misaligned, the bumper chamfered peripheral edge guides the inner member web over the bumper preventing bumper disengagement.

In another aspect, the invention provides a drawer slide assembly which comprises an outer slide member and an inner slide member slideably coupled to the outer slide member. The inner slide member has a web and a bent leg portion extending along each edge of the web defining a channel. A tab is located at the end of the outer slide member extending into the space defined by the channel. An elastomeric bumper having an upper and a lower end is mounted on the tab by means of a central slot extending through the bumper. When mounted on the tab, the slot length is wider than the tab permitting the bumper to "float" or slide from side to side on the tab and the legs of the inner slide member engage an outer surface of the bumper for slideably moving the bumper on the tab when the slide member is in a closed position.

DETAILED DESCRIPTION OF THE INVENTION

Figure 1:
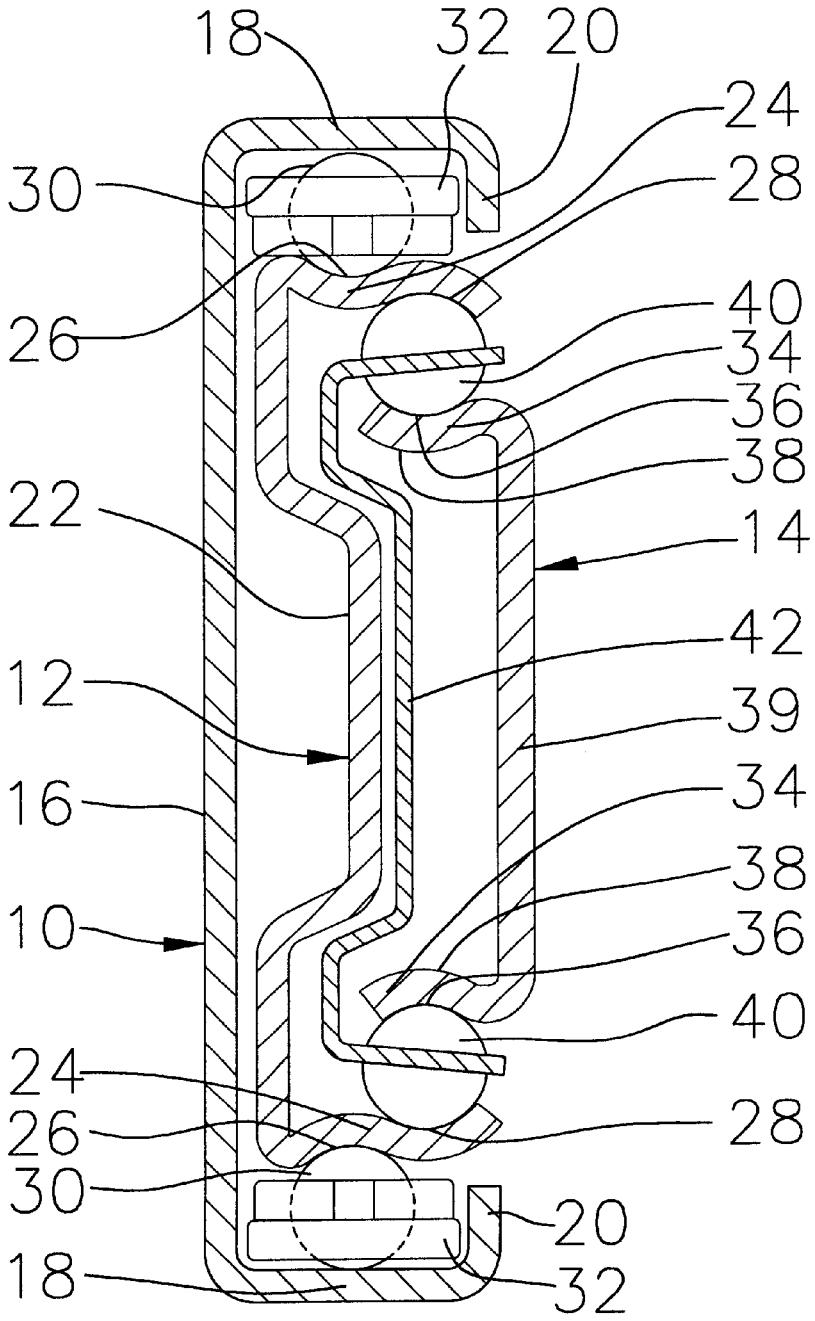
FIG. 1 PRIOR ART
FIG. 1 is a cross-sectional view of a drawer slide according to the prior art.

Drawer slides according to the prior art typically consist of a stationary member and one or more telescoping member. The stationary member is typically mounted on a cabinet while one of the telescoping member is connected to the drawer. A typical three drawer slide, for example, comprises a stationary channel-shaped member 10 (FIG. 1). An intermediate channel-shaped slide member 12 is coupled to slide within the "channel" of the stationary member 10. An inner channel-shaped slide member 14 is coupled to slide within the "channel" of the intermediate member 12.

In cross-section, the stationary member has web 16 having an upper and a lower end. A leg 18 extends from each end perpendicularly to the web 16 forming a channel. Each leg spans the length of the stationary member. A lip 20 is formed at the end of each leg and extends the length of the stationary member. The lip is formed by perpendicularly bending an end portion of each leg 90° toward the web.

The intermediate channel member 12 has a height that is smaller than the height of the outer channel member. The intermediate member also has a web 22 as well as a perpendicular leg 24 extending from each end of the web so as to form a channel. Each leg of the intermediate member is "S" shaped in cross-section so as to form an outer 26 and an inner 28 bearing raceway along its length.

The intermediate member is coupled to the channel of the stationary member via ball bearings 30. These ball bearings ride on the inner surface of each of the stationary member legs and on the outer raceway formed on each of the intermediate member legs. The lip on each leg of the stationary member serves as a retainer wall for the ball bearings. The ball bearings are fitted within retainers 32 which are themselves retained by the lips 20.

The inner channel-shaped sliding member has a height smaller than that of the intermediate member. The inner channel member is slidably mounted within the intermediate slide member. The legs 34 of the inner member are curved in cross-section having an outer concave bearing raceway 36 and an inner concave surface 38. These legs also extend perpendicularly from a web 39.

The inner member is coupled to the intermediate member using ball bearings 40. These ball bearings are preferably fitted within a channel-shaped retainer 42 which is fitted between the inner and intermediate slide members. The ball bearings between the intermediate and inner members ride on the inner bearing raceways formed on the legs of the intermediate member and on the outer raceways formed on the inner member legs.

Figure 2:
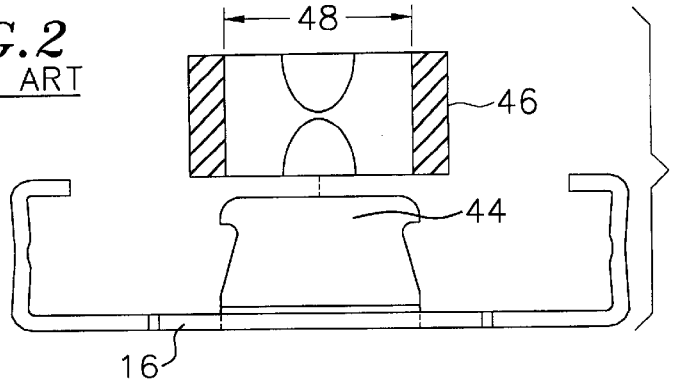
FIG. 2 PRIOR ART
FIG. 2 is a rear end view of the stationary member of a typical prior art drawer slide having a rear stop tab and a bumper in cross section prior to mounting on the tab.
Figure 3:
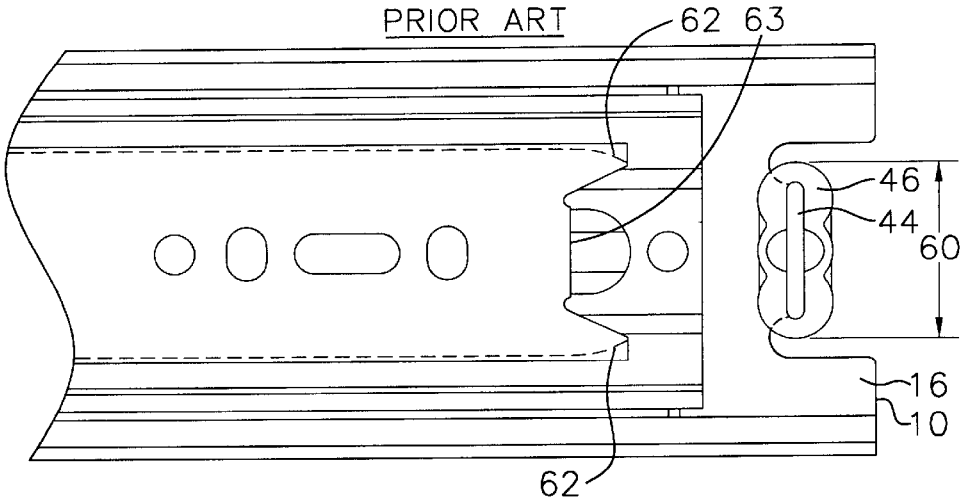
FIG. 3 PRIOR ART
FIG. 3 is a top view of portion of the rear end of a typical prior art three member drawer slide.
Figure 4:
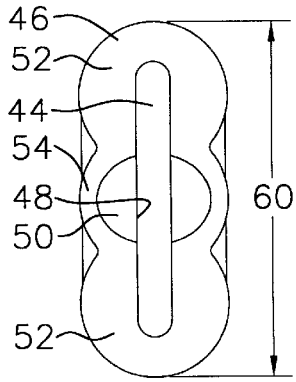
FIG. 4 PRIOR ART
FIG. 4 is a top view of a typical bumper used with the stop tab shown in FIG. 2.

A rear stop element is located at the rear end of the stationary slide member (FIG. 2). The rear stop is formed by bending a central portion of the web 16 such that it extends into channel defined by the stationary slide member. As shown, the rear stop member is a tab 44 extending up and into the pathways of the intermediate and inner slide members (FIGS. 2 and 3). An elastomeric bumper 46 having a central slot 48 is shown above the tab 44 prior to its being mounted on the tab. As shown, slot 48 is narrower than the width of tab 44 requiring the bumper and slot to be stretched and tensioned and force fitted over the tab. Bumper 46 is forced over the rear stop member such that it encloses the stop member except at its open ends (FIG. 4). The slot 48 extends through the body of the bumper 46 from its top end to its bottom end. Since the slot 48 is narrower than the width of the stop member, this causes the bumper to be stretched when placed on the tab. A circular recess 50 is formed in the center of the bumper intersecting the slot. The bumper outer surface is defined by three intersecting cylindrical sections having their centers aligned along the plane of the slot, two end cylindrical sections 52 and a center cylindrical section 54.

Figure 5:
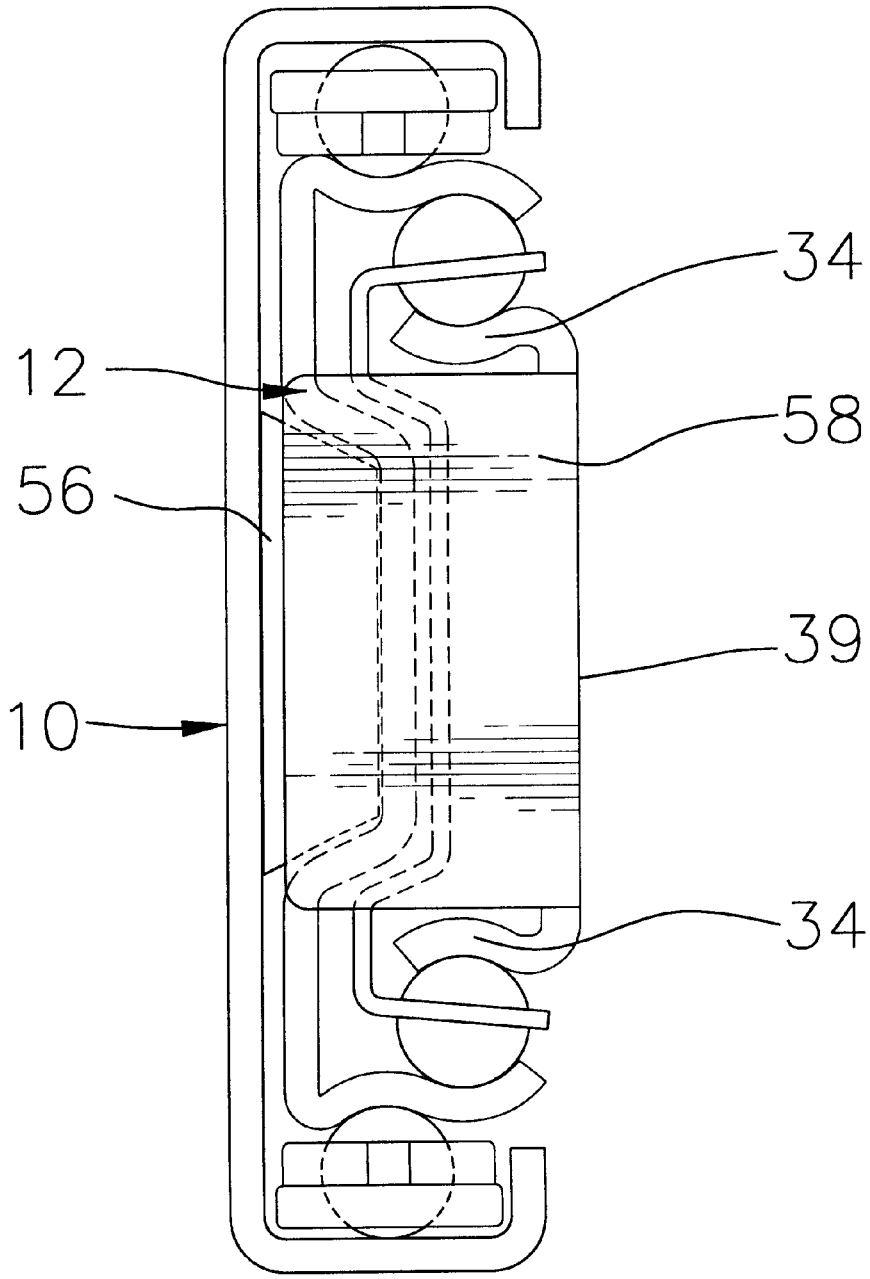
FIG. 5 PRIOR ART
FIG. 5 is a front end elevation view of a drawer slide according to the prior art.

A second stop member 56 is located on the stationary member at the front end of the slide (FIG. 5). A bent flange portion 58 of the web 39 of the inner member extends upwardly into the channel defined by the inner member legs 34. The flange portion 58 is bent inward at a 90° angle and is longer than the depth of the inner member legs channel and extends to the point where it overlaps a substantial portion of stop member 56. When the inner member is retracted to the closed position, the bent flange 58 engages the stop member 56 to stop travel of the inner member.

When fitted over the rear stop member, the overall dimension 60 of the bumper is slightly longer than the shortest distance between the inner surfaces of the legs 34 of the inner member. In the usual configuration, a section of the web of the inner member at its rear end is cutout or relieved such that the two inner member legs extend beyond the end of the web. The portions of the legs 62 extending beyond the cutout 63 are squeezed or bent toward each other a small distance such that the distance between the interior surface of each leg at the rear end of the inner member is shorter than dimension 60 of the stop member. The cutout 63 facilitates the bending of the ends without buckling the web.

The bumper according to the present invention preferably has the same outer dimensions as the bumpers described in the background of the invention herein (as shown in FIG. 4). Tab 44 is provided with a cutout or notch 70 along each of its side edges. While a notch on one of the side edges of the tab is sufficient, a cutout 70 on each side edge is preferred. Each cutout 70 preferably has a horizontal upper edge 72 and a tapering lower edge 74. While tab 44 is shown as being located on the inner slide member, in alternative embodiments, the tab is located on the outer slide member in one embodiment and an intermediate slide member in a second embodiment. In each case, the self centering bumper according to the present invention is mounted on the tab.

Figure 7A:
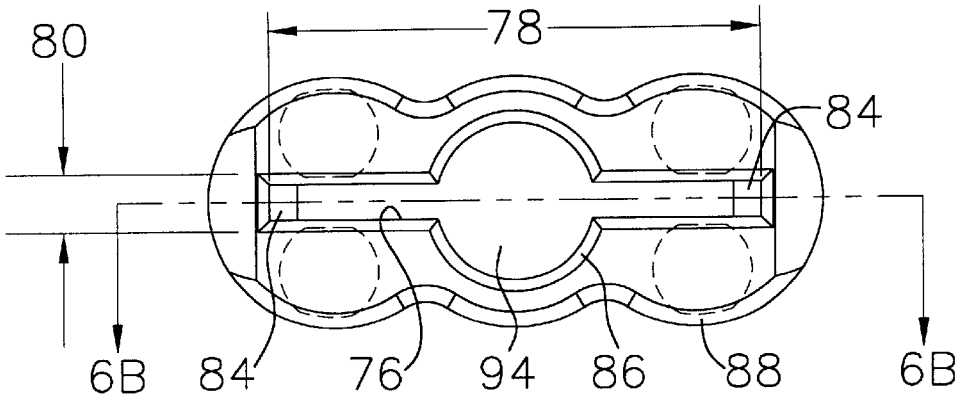
FIG. 7A is a top view of the bumper according to the present invention.
Figure 7B:
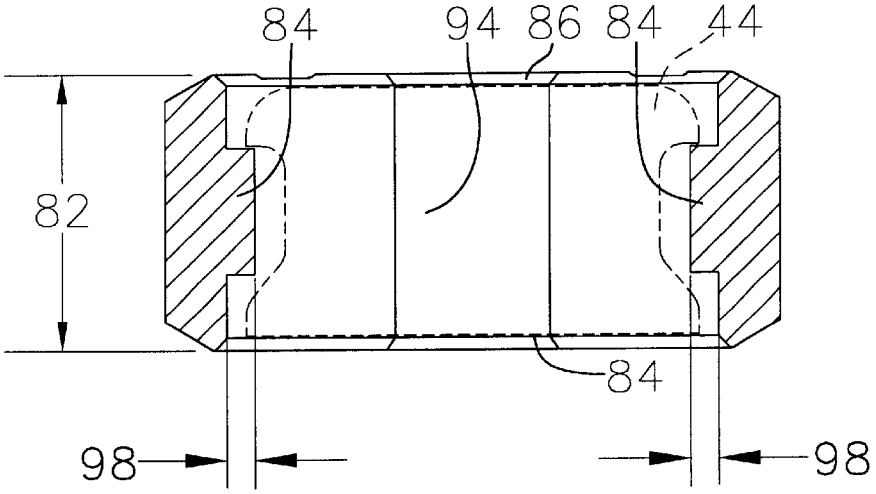
FIG. 7B is a cross-sectional view of the bumper taken along lines 7B—7B of FIG. 7A.

The bumper of the present invention has a slot 76 to receive the rear stop tab. The slot has a length 78, width 80 and height 82 dimension (FIGS. 7A, 7B). The slot extends through the bumper from top to bottom. A projection 84 is formed in each interior side wall of the slot and projects within the slot, i.e. along the length or longitudinal dimension. Each projection is designed to extend into notches 70 when the bumper is in place. It is preferred that the bumper has a projection for each notch formed on the stop tab. Therefore, if the stop tab has a cutout 70 on each of its side edges, it is preferable that a projection 84 is provided on each side edge of the slot.

All of the edges 86, 87 of the slot on the upper and lower end of the bumper are chamfered (FIGS. 7A and 7B). Chamfering of the slot edges facilitates the installation of the bumper on the rear stop tab. The chamfered slot edge 86 serves as a guide causing the bumper slot to align and slide over the tab during installation. It is preferable that the slot edges at both bumper ends are chamfered so as to facilitate insertion of either end of the bumper onto the tab.

The bumper perimeter edges 88 are also chamfered. In this regard, if the inner member inclines toward or bears against the outer or intermediate member when approaching a closed position, the inner member web rear end comes into contact with the chamfered edge 88. As a result, the chamfer in the edge guides the web over the bumper, thereby, preventing the web from digging into the bumper and lifting the tab. It is preferred that all peripheral edges on the bumper be chamfered to facilitate mounting the bumper from either end.

Making the bumper orientation neutral provides a big advantage in that the person mounting the bumper on the rear stop tab will not have to worry about the bumper orientation relative to the tab. In an automated process of mounting the bumper to the tab, an orientation neutral bumper simplifies the operation.

Figure 6:
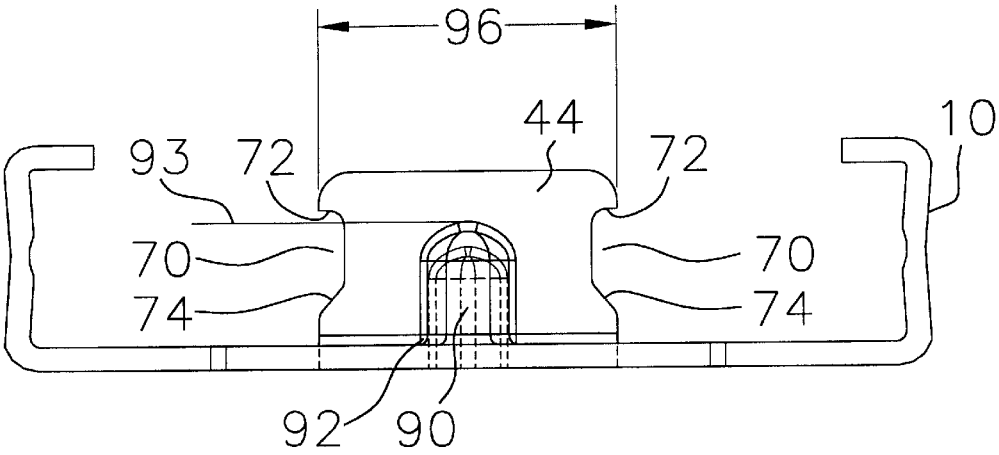
FIG. 6 is a rear end view of a stationary member having a rear stop tab for accommodating the bumper of the present invention.
Figure 7C:
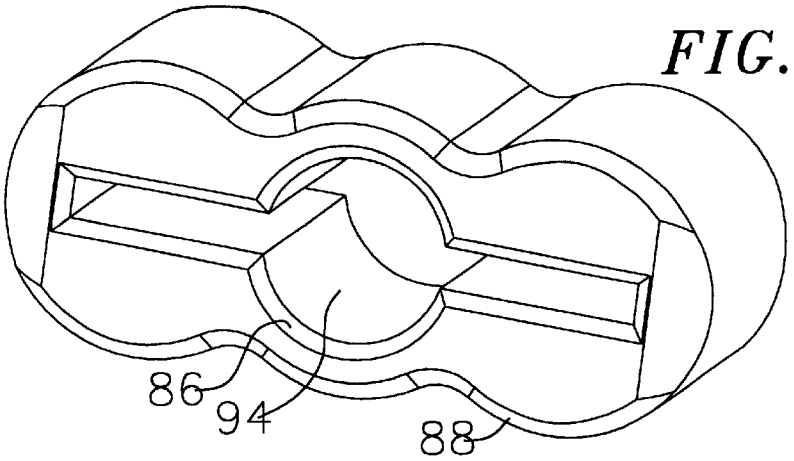
FIG. 7C is a perspective view of the bumper according to the present invention.

In many slides the rear stop tab fails prematurely by breaking off. To prolong the life to the tab, a gusset 90 is typically attached to the rear surface of the tab 44 (FIG. 6). Because the slides which incorporate the inventive bumpers are generally the same as the slides of the prior art, the components of the slides incorporating the inventive bumpers are not described herein since they have already been described in relation to the prior art. Moreover, for convenience, the reference numerals used on the slide components of the slide members shown in FIGS. 6, 8 and 9 incorporating the inventive bumpers are the same as the reference numerals used for the same components on the prior art slide members disclosed in FIGS. 1–5. The gusset typically extends from the base 92 of the tab to a level 93 above the tab mid-height. Preferably, the gusset is attached along the center of the tab. To accommodate the gusset, an opening 94 is formed in the bumper (FIGS. 7A, 7B and 7C). The opening intersects the slot. To make the bumper orientation neutral however, a cylindrical opening is formed spanning the entire height of the bumper i.e., from the bumper upper end to the bumper lower end. The diameter of the opening is such that when the bumper is mounted on the tab, the gusset does not exert any pressure on the bumper. This freedom to move from side to side enables the bumper to center itself between the legs of the engaging slide member.

The length dimension 78 of the slot is specifically configured to be greater than the maximum dimension 96 of the stop tab to eliminate any tension on the bumper when mounted and allow the bumper to move from side to side on the tab during extension and retraction of the slide inner member.

Figure 8:
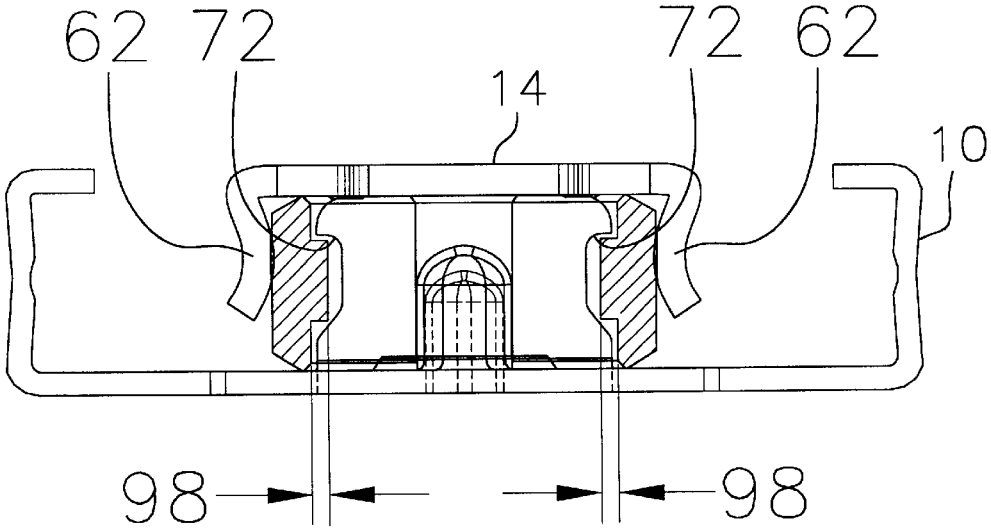
FIG. 8 is an end view of the bumper of the present invention mounted over the rear stop tab of a two member slide.

The length 98 of the projection 84 is such that when the bumper is mounted over the stop member, each projection extends into the space defined by each cutout 70 (i.e. notch) on the stop tab without contacting the notches (FIG. 8). When attempting to disengage the bumper from the stop tab, the projections engage the upper edges 72 of the cutouts and resist the disengagement.

Figure 9:
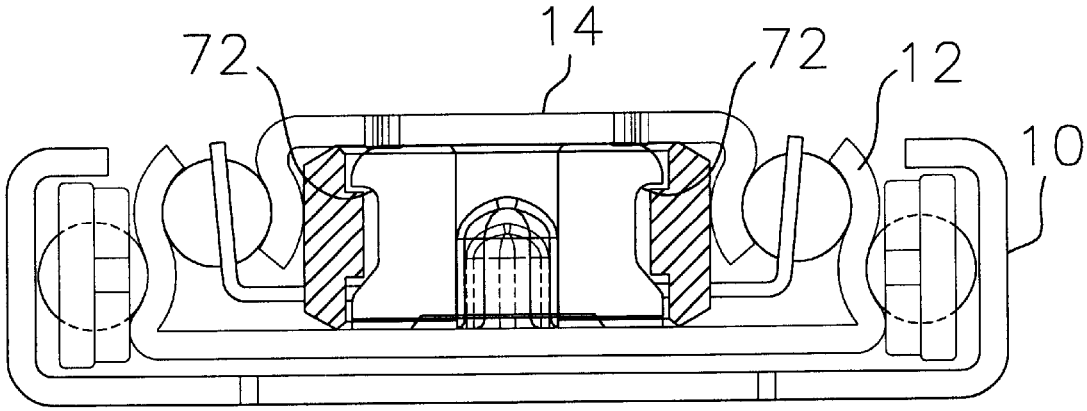
FIG. 9 is an end view of the bumper of the present invention mounted over the rear stop tab of the intermediate member of a three member slide.

The function of the floating bumper of the present invention remains the same as in the prior art. As the inner slide member is retracted, the rear end 62 of the legs of the inner member which are slightly canted inwardly engage and compress the rubber bumper (FIG. 9). As the inner member is slid farther backwards, the canted portions of the bent legs move past the rear bumper allowing the bumper to expand and retain the slide and drawer in a closed position. The retention force in the closed position is determined by the bumper shape and composition. Thus, manufacturing variations in dimensions of mounting tabs do not affect retention force as in prior art.

The relative dimensions of the tab and slot are chosen in order to permit the bumper to slide from side to side when engaged by the inner slide member to center itself between the bent legs of the inner member thereby reducing the wear and tear normally encountered by a prior art force fitted bumper and significantly extending the bumper life. As can be seen from FIG. 8, when the bumper is mounted over the stop member, it is a "floating bumper," i.e., it is not being stretched by the rear stop tab.

The retention force for bumpers of other shape and design can also benefit from this "floating bumper," concept and though not illustrated, will be understood by others skilled in the art. Likewise, those skilled in the art can easily see other common mounting arrangements, such as mounting the "floating bumper" on the inner member and engaging with formed up tabs from the outer member.

What is claimed is:

1. A drawer slide assembly comprising:

an outer slide member;

an inner slide member slidably coupled to the outer slide member, the inner member having a web and a bent leg portion along each edge of the web defining a channel;

a tab located at an end of the outer slide member, the tab extending into the channel and having a width; and an elastomeric bumper engageable by the inner slide member and having an upper end and a lower end mounted on the tab by means of a central slot extending through the bumper wherein the slot comprises a length, said length being longer than said tab width, wherein when mounted on the tab and when not engaged by the inner slide member, the bumper is not under tension and the bumper can slide relative to the tab in a direction along the slot length, and wherein the inner slide leg portions engage an outer surface of the bumper for centering the bumper between the leg portions when the inner slide member is moved to a closed position.

2. A slide assembly as recited in claim 1 wherein the tab comprises two opposite edges extending transversely from the outer member and wherein a notch is formed on at least one edge, and wherein the bumper has a protrusion formed within the slot for registering with the notch.

3. A slide assembly as recited in claim 2 wherein a notch is formed on each of the two edges.

4. A slide assembly as recited in claim 3 wherein the bumper includes a projection corresponding to each notch and wherein a projection extends into each notch.

5. A slide assembly as recited in claim 2, wherein the protrusion is not in contact with the notch.

6. A slide assembly as recited in claim 1 wherein the width of the slot is greater than the thickness of the tab.

7. A slide assembly as recited in claim 1 wherein the slot forms edges at its intersection with the upper and lower ends of the bumper and wherein at least one edge of the slot is chamfered.

8. A slide assembly as recited in claim 7 wherein a slot edge formed on the opposite end of the bumper is chamfered.

9. A slide assembly as recited in claim 1 wherein the bumper has an upper and a lower peripheral edge and wherein a portion of at least one of the peripheral edges is chamfered.

10. A slide assembly as recited in claim 9 wherein the portion of the upper peripheral edge facing the inner member is chamfered.

11. A slide assembly as recited in claim 1 wherein the bumper has an upper and a lower chamfered peripheral edge.

12. A slide assembly as recited in claim 1 wherein the bumper has a central passage intersecting the slot and extending into the interior of the bumper.

13. A slide assembly as recited in claim 12 further comprising a gusset attached to the stop tab wherein the bumper passage receives the gusset.

14. A slide assembly as recited in claim 13 wherein when the bumper is mounted on the tab, the passage is not tensioned by the gusset.

15. A slide assembly as recited in claim 1 wherein the elastomeric bumper can float relative to the tab.

16. A drawer slide assembly comprising:

an inner slide member;

an outer slide member slidably coupled to the outer slide member, the outer member having a web and a bent leg portion along each edge of the web defining a channel;

a tab located at an end of the inner slide member, the tab extending into the channel and having a width; and an elastomeric bumper engageable by the outer slide member and having an upper end and a lower end mounted on the tab by means of a central slot extending through the bumper wherein the slot comprises a length, said length being wider than said tab width, wherein when mounted on the tab and when not engaged by the outer slide member, the bumper is not under tension and the bumper can slide relative to the tab in a direction along the slot length, and wherein the outer slide leg portions engage an outer surface of the bumper for centering the bumper between the leg portions when the outer slide member is moved to a closed position.

17. A slide assembly as recited in claim 16 wherein the elastomeric bumper can float relative to the tab.

18. A drawer slide assembly comprising:

an inner slide member;

an intermediate slide member slidably coupled to the inner slide member;

an outer slide member slidably coupled to the intermediate slide member;

a tab located at an end of the intermediate member, the tab extending into the channel and having a width; and an elastomeric bumper engageable by one said inner and outer slide members and having an upper end and a lower end mounted on the tab by means of a central slot extending through the bumper the slot comprises a length, said length being wider than said tab width, wherein when mounted on the tab and when not engaged by said inner and outer slide members, the bumper is not under tension and the bumper can slide relative to the tab in a direction along the slot length, and wherein said one of said inner and outer members engage an outer surface of the bumper for centering the bumper between the leg portions when the inner slide member is moved to a closed position.

19. A slide assembly as recited in claim 18 wherein the elastomeric bumper can float relative to the tab.

* * * * *